United States Patent [19]

Wright, Jr.

[11] Patent Number: 4,836,095

[45] Date of Patent: Jun. 6, 1989

[54] STATIC PRESSURE CONTROL IN VARIABLE AIR VOLUME DELIVERY SYSTEM

[75] Inventor: Edward F. Wright, Jr., Clay, N.Y.

[73] Assignee: Carrier Corporation, Syracuse, N.Y.

[21] Appl. No.: 173,010

[22] Filed: Mar. 28, 1988

Related U.S. Application Data

[63] Continuation of Ser. No. 936,424, Dec. 1, 1986, abandoned.

[51] Int. Cl.[4] ..... F24F 7/08

[52] U.S. Cl. ..... 98/31.6; 165/22; 165/31

[58] Field of Search ..... 98/31.5, 31.6, 39.1, 98/34.6, 1; 165/22, 31; 236/1 B, 11, 13, 49

[56] References Cited

U.S. PATENT DOCUMENTS

| | | | |
|---|---|---|---|
| 3,275,068 | 9/1966 | McGrath | 165/31 |
| 3,293,876 | 12/1966 | Geisler | 62/184 |
| 3,865,181 | 2/1975 | Mori et al. | 165/31 X |
| 4,011,735 | 3/1977 | Martz et al. | 165/31 X |
| 4,186,655 | 2/1980 | Mallory et al. | 165/22 X |
| 4,203,485 | 5/1980 | Zilbermann | 165/31 X |

FOREIGN PATENT DOCUMENTS

| | | | |
|---|---|---|---|
| 2909628 | 9/1980 | Fed. Rep. of Germany | 165/31 |

*Primary Examiner*—Harold Joyce
*Attorney, Agent, or Firm*—Dana F. Bieglow

[57] ABSTRACT

A method and apparatus for supplying variable amounts of air to an air volume delivery system (130) including supply ductwork (210) to air terminals (220), with a multi-speed motor (180) subject to direction by controller (200) to produce variable time rates of air volume passing into said ductwork (210) in response to static pressure (as measured by detector (310) exceeding predetermined limits.

9 Claims, 2 Drawing Sheets

STATIC PRESSURE CONTROL IN VARIABLE AIR VOLUME DELIVERY SYSTEM

This application is a Continuation of application Ser. No. 936,424 filed Dec. 1, 1986 now abandoned.

BACKGROUND OF THE INVENTION

This invention is directed toward the art of effectively operating variable air volume delivery systems, and particularly toward the control of static pressure in the supply ducts of said variable air volume delivery systems during the delivery of air irrespective of the amount of air delivered in such systems.

One example of a variable air volume delivery system includes rooftop air conditioners in the 20–100 ton operational range, which include extensive ductwork to the rooms and spaces subject to air delivery. Such air conditioners frequently face the problem of controlling static pressure in their ductwork during variable air volume applications, because of the need to continually modify the amounts and quantities of air needed to be delivered in order to establish effective building temperature control with regard to conditioned and conditionable rooms and spaces therein.

The problem of static pressure control can be usefully understood and illustrated by the following example. As the need for cooling a room or space to be conditioned decreases, the air terminals in the rooms and spaces addressed begin to modulate between open and closed states, to reduce the amount of air delivered to the region being conditioned. This of course increases the static pressure delivery by the blower of the variable air volume delivery system driving the air in direct relationship to the reduction in the amount of air delivered.

In other words, as the amount of air is reduced with diminished need, the system itself requires only a reduced level of static pressure. Instead, the level of static pressure is in fact increased, because less amounts of air are actually lost during operation under reduced air flow conditions.

Significantly, not only are static pressure levels at their maximum just when they are clearly least needed, but the excessive level of static pressure applied at repeated intervals can indeed increase energy costs and additionally cause damage to the ductwork of the air volume delivery system being operated and also to the room terminals delivering the air to the spaces being conditioned.

It would thus be advantageous to regulate, or reduce, the static pressures present during system operation for many reasons relating both to energy savings and to the structural integrity and mechanical maintenance of the system. Beyond that, it is of course clear that solving the static pressure problem indicated would tend to promote energy savings for the user and to reduce the work done by the air volume delivery system blower which bears in substantial part the burden of producing such excessive static pressure levels.

SUMMARY OF THE INVENTION

In view of the problems indicated above, the regulation of static pressure in variable air volume delivery systems is proposed in a manner effective for changing fan or blower speed stepwise in response to static pressure measured in the duct work of the air volume delivery system. According to one aspect of the invention, blower fan speed is controlled under direction of a multi-speed motor in turn controlled by a motor controller, capable of operation at two or more discrete speeds.

According to the invention herein, when duct static pressure rises to an excessive level, the fan motor is switched to a next lower speed by action of the motor controller in response to a pressure detector in the supply duct of the air volume delivery system, which pressure detector is effective for delivering a signal indicative of pressure levels detected therein. The speed change of the fan motor and its connected blower arrangement in turn is effective for producing a reduction in static pressure for example proportional to the square of the ratio of initial and final revolutions per second, as will be seen. Concurrently therewith, according to the invention, the quantity of air delivered in cubic feet per minute for example, will be reduced in direct proportion to the ratio of initial and final revolutions per second.

DESCRIPTION OF THE PREFERRED EMBODIMENT

Figure 1:
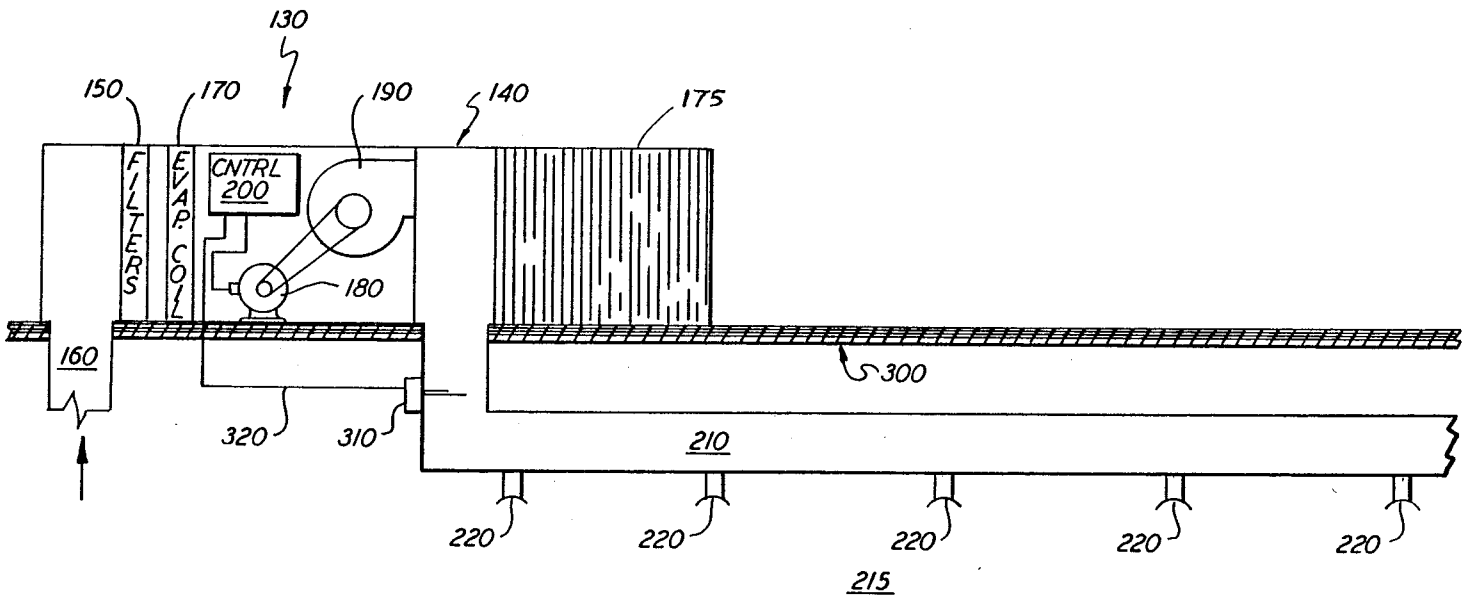
FIG. 1 is a schematic illustration of a typical centrifugal blower system used for air conditioning and variable air volume delivery, and employing supply and return ducts leading to and from the rooms and spaces to be conditioned.

FIG. 1 shows a variable air volume delivery system 130 including an outer cabinet 140 containing filters 150 for receiving air from a return duct 160, an evaporator coil 170 for conditioning the air received from filters 150, a condenser arrangement 175, and a motor 180 for driving a centrifugal blower 190 subject to the direction of motor controls 200, the centrifugal blower 190 being effective for blowing the air passing through the evaporator coils 170 out of cabinet 140 into supply duct 210 and then in turn into the rooms and spaces 215 to be conditioned by way of respective room terminals 220. Such a system 130 further includes a conventional and well known closed loop refrigerant system and a compressor (not shown) for circulating refrigerant between condenser 175 and evaporator coil 170. It is however not an object herein to address the features and operation of the refrigerant system which operates in conjunction with the air delivery objectives of direct interest herein. The outer cabinet 140 is moreover supported on a substantial roof structure 300 as suggested in FIG. 1. Supply duct 210 is further subject to measurement by a static pressure sensor 310, which communicates along line 320 with motor controller 200 to provide an indication of pressure levels detected by sensor 310.

Figure 2:
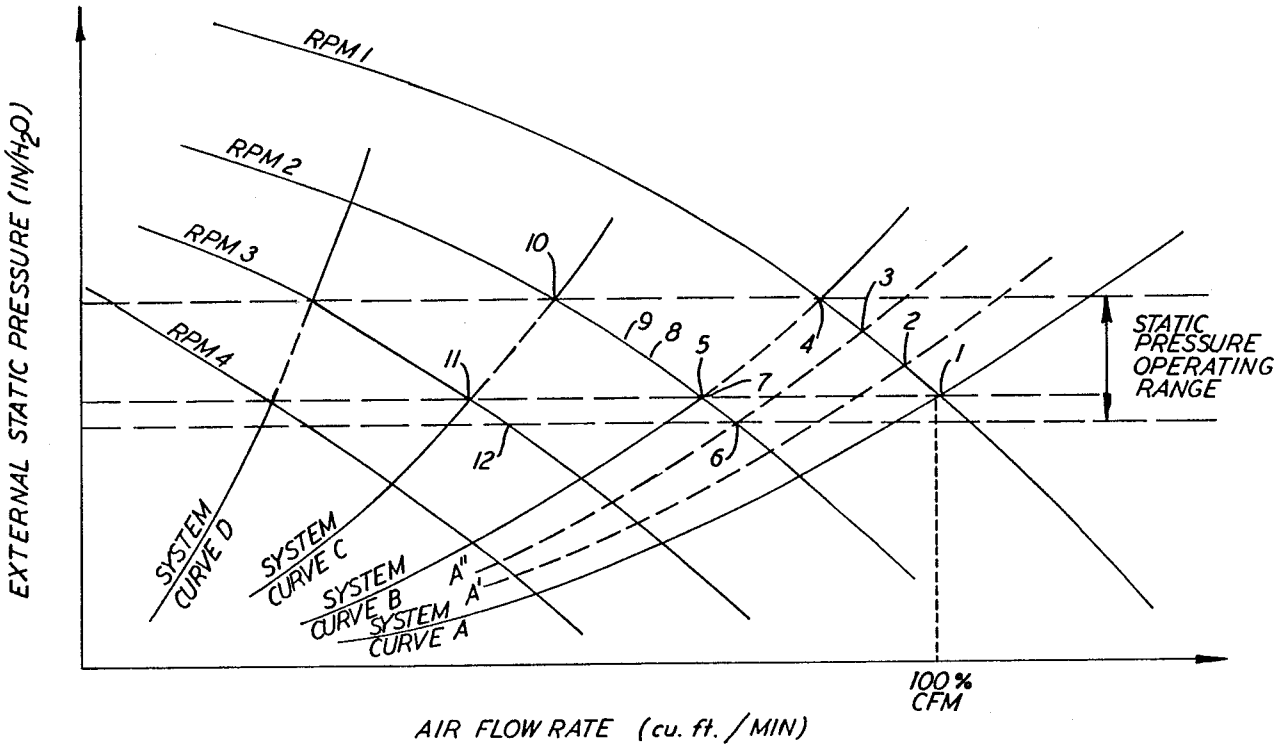
FIG. 2 is a graph displaying the operating characteristics of the air volume delivery system according to FIG. 1, in particular indicating external static pressure in inches of water as a function of air flow rate in cubic feet per minute.

The operation of the blower system 130 of FIG. 1 proceeds according to the invention herein, in accordance with the scheme set forth in FIG. 2, which scheme is programmed into motor controls or controller 200 according to well known techniques. In particular, point 1 on the characteristic curves of FIG. 2 suggests the condition of operation by system 130 at highest revolutions per second with the room terminals 220 delivering a maximum load in cubic feet per minute, as per system curve "A", which shows how the air volume delivery system 130 operates for a given setting of air terminals 220.

Further, point 2 of the operational graph set forth in FIG. 2 suggests operation according to system curve A' with reduced air flow, at which time the room terminals 220 will have been throttled into a slightly closed condition to somewhat restrict air flow into the rooms or spaces to be conditioned.

Point 3 shown in FIG. 2 suggests a condition of even greater throttled operation as per indicated system curve A''. Point 4 of the Figure in turn sets forth the condition at which the room terminals 220 have been closed sufficiently to cause the level of static pressure to reach an upper limit setting for motor controls 220 for the given level of revolutions per minute. At said limit, the fan motor 180 is, according to the invention, switched to a next lower speed, represented by "RPM2".

At point 5 of the operational characteristic, system operation is repeated according to the outer section of system curve B for a new level "2" of revolutions per minutes as indicated on FIG. 2, at which time the fan effect of centrifugal blower 190 slows down and the air flow rebalances at a new state of operation. Point 6 accordingly is suggestive of the operating point of system 130 with the room terminals 220 opened slightly to compensate for the reduction in flow rate (in cubic feet per minute) caused by the change in fan speed. Points in turn 7–12 are the operating points of system 130 which are analogous to points 1–6 discussed above, but which represent the operationsl transition between motor states "2" and "3", whereas points 1–6 describe the transition between motor states "1" to "2" as described immediately above.

While this invention has been described with reference to a particular embodiment disclosed herein, it is not confined to the details set forth herein and this application is intended to cover any modifications or changes as may come within the scope of the invention.

What is claimed is:

1. The method of supplying variable amounts of air to an air volume delivery system including a blower, a multi-speed motor for driving said blower, a motor controller for controlling the speed of said motor in a step-wise manner, a return duct bringing air to the blower, and a supply duct including room terminals, for moving variable quantities of air from the blower to selected rooms through corresponding room terminals, said blower effective for controllably blowing air from said return duct into said supply duct and through selected ones of said room terminals, said method comprising the steps of:

(a) blowing air into the supply duct with said blower being driven at a first selected motor speed and within a predetermined static pressure operating range including upper and lower limits, with said blower being susceptible to increasing static pressures within said operating range, and (b) when the static pressure reaches the upper limit of said static pressure operating range, switching to a lower motor speed with an associated blower static pressure which is above said lower limit.

2. The method of claim 1, wherein said rates of volume correspond to respective ones of selected motor speeds.

3. The method of claim 1, including the step of detecting static pressure in said supply duct.

4. The method of claim 3, including the step of providing an indication of detected static pressure to said motor controller.

5. An apparatus for supplying variable amounts of air to an air volume delivery system including a blower, a multispeed motor for driving said blower, a motor controller for controlling the speed of said motor in a stepwise fashion, a return duct bringing air to the blower, a supply duct including room terminals for moving variable quantities of air from the blower to selected rooms through corresponding room terminals, said blower effective for controllably blowing air from said return duct into said supply duct and through selected ones of said room terminals, means for blowing air into the system with the blower being driven at a first selected motor speed and at increasing static pressures within a predetermined static pressure operating range including upper and lower limits, and means for switching to a lower motor speed when the static pressure reaches the upper limit of said static pressure operating range said lower motor speed being sufficient to maintain the static pressure above said lower limit.

6. The apparatus of claim 5, wherein said means for switching includes said motor controller.

7. The apparatus of claim 5, wherein said means for blowing air includes said multi-speed motor.

8. The apparatus of claim 5, further comprising means for detecting static pressure in said supply duct.

9. The apparatus of claim 8, further including a means for providing an indication of said detected static pressure to said motor controller.

* * * * *